US006612916B2

(12) United States Patent
Kollodge et al.

(10) Patent No.: US 6,612,916 B2
(45) Date of Patent: Sep. 2, 2003

(54) ARTICLE SUITABLE FOR CHEMICAL MECHANICAL PLANARIZATION PROCESSES

(75) Inventors: Jeffrey S. Kollodge, Woodbury, MN (US); Robert P. Messner, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 158 days.

(21) Appl. No.: 09/756,376

(22) Filed: Jan. 8, 2001

(65) Prior Publication Data

US 2002/0151253 A1 Oct. 17, 2002

(51) Int. Cl.[7] ..... B24D 11/00
(52) U.S. Cl. ..... 451/527; 451/529; 451/550
(58) Field of Search ..... 451/41, 59, 63, 451/527, 539, 550

(56) References Cited

U.S. PATENT DOCUMENTS

| | | | | |
|---|---|---|---|---|
| 5,020,283 A | | 6/1991 | Tuttle | |
| 5,152,917 A | | 10/1992 | Pieper et al. | |
| 5,177,908 A | | 1/1993 | Tuttle | |
| 5,297,364 A | | 3/1994 | Tuttle | |
| 5,489,233 A | | 2/1996 | Cook et al. | 451/41 |
| 5,692,950 A | | 12/1997 | Rutherford et al. | 451/552 |
| 5,888,121 A | | 3/1999 | Kirchner et al. | 451/41 |
| 5,958,794 A | | 9/1999 | Bruxvoort et al. | 438/692 |
| 6,007,407 A | | 12/1999 | Rutherford et al. | 451/41 |
| 6,022,264 A | | 2/2000 | Cook et al. | 451/37 |
| 6,099,390 A | * | 8/2000 | Nishio et al. | 451/41 |
| 6,299,508 B1 | * | 10/2001 | Gagliardi et al. | 451/28 |
| 6,332,832 B1 | * | 12/2001 | Suzuki | 451/41 |
| 6,390,891 B1 | * | 5/2002 | Guha et al. | 451/548 |

FOREIGN PATENT DOCUMENTS

| | | |
|---|---|---|
| DE | 198 28 477 A1 | 1/1999 |
| JP | 11048128 | 2/1999 |
| WO | WO 95/22436 | 8/1995 |

OTHER PUBLICATIONS

Presentation given at Camp 4$^{th}$ Annual International Symposium on Chemical–Mechanical Polishing, Aug. 8–11, 1999.

Presentation given at Camp 4$^{th}$ Annual International Symposium on Chemical–Mechanical Polishing, Aug. 9–11, 1999.

* cited by examiner

*Primary Examiner*—Timothy V. Eley
(74) *Attorney, Agent, or Firm*—Colene H. Blank

(57) ABSTRACT

A method of chemically modifying a wafer suited for fabrication of semiconductor devices includes a) contacting a surface of wafer with an article that includes a plurality of unit cells repeating across the surface of the article, the individual unit cells including at least a portion of a three-dimensional structure and being characterized by a unit cell parameter as follows:

$$[[V_1-Vs]/Aas]/\sqrt{Auc}>5$$

where $V_1$ is the volume defined by the area of the unit cell and the height of the structure of the unit cell, Vs is the volume of the structure of the unit cell, Aas is the apparent contact area of the structure of the unit cell, and Auc is the area of the unit cell, and b) moving at least one of the wafer and the article relative to each other in the presence of a polishing composition that is chemically reactive with a surface of the wafer and capable of either enhancing or inhibiting the rate of removal of at least a portion of the surface of the wafer.

15 Claims, 8 Drawing Sheets

ARTICLE SUITABLE FOR CHEMICAL MECHANICAL PLANARIZATION PROCESSES

BACKGROUND OF THE INVENTION

The invention relates to increasing the associated volume of polishing composition relative to contact area in chemical mechanical planarization processes.

Three-dimensional fixed abrasive polishing pads have been used in chemical mechanical planarization processes to planarize and polish dielectrics, metal lines and interconnects present on the surface of a wafer suited for fabrication of semiconductor devices. The three-dimensional structures on these polishing pads extend from a substrate surface in the form of circular posts, square posts, hexagonal posts, pyramids and truncated pyramids.

During many chemical mechanical planarization processes, a polishing composition is brought in contact with a semiconductor wafer surface. The polishing composition chemically modifies the wafer surface rendering the surface more amendable to removal. Fixed abrasive polishing pads and many particle slurry pad combinations used in chemical mechanical planarization processes work to remove the modified layer of the wafer and spent polishing composition, which enables the surface-modification/removal process to be repeated until the desired final properties of the wafer surface are obtained.

SUMMARY

In one aspect, the invention features a method of chemically modifying a wafer suited for fabrication of semiconductor devices that includes a) contacting a surface of the wafer with an article that includes a plurality of unit cells repeating across the surface of the article, the individual unit cells including at least a portion of a three-dimensional structure and being characterized by a unit cell parameter as follows:

$$[[V_1-Vs]/Aas]/\sqrt{Auc}>5$$

where $V_1$ is the volume defined by the area of the unit cell and the height of the structure of the unit cell, Vs is the volume of the structure of the unit cell, Aas is the apparent contact area of the structure of the unit cell, and Auc is the area of the unit cell, and b) moving at least one of the wafer and the article relative to each other in the presence of a polishing composition capable of chemically reacting with the surface of the wafer and being capable of either enhancing or inhibiting the rate of removal of at least a portion of the surface of the wafer.

In one embodiment, the portion of the wafer includes a chemically distinct phase of the wafer. In another embodiment, the unit cell includes a plurality of three-dimensional structures. In other embodiments $[[V_1-Vs]/Aas]/\sqrt{Auc}\geqq 10$. In some embodiments $[[V_1-Vs]/Aas]/\sqrt{Auc}\geqq 15$. In one embodiment $[[V_1-Vs]/Aas]/\sqrt{Auc}\geqq 20$.

In another embodiment, at least one dimension that defines the apparent contact area of the structure is from 1 $\mu$m to no greater than 500 $\mu$m. In other embodiments, at least one dimension that defines the apparent contact area of the structure is from 1 $\mu$m to no greater than 200 $\mu$m. In another embodiment, the apparent contact area of an individual structure is from 1 $\mu m^2$ to 200,000 $\mu m^2$.

In one embodiment, the height of the structure is from 10 $\mu$m to 500 $\mu$m. In some embodiments, 15 $\mu m \geqq \sqrt{Auc} \geqq 2000$ $\mu$m.

In other embodiments the unit cell includes one three-dimensional structure. In another embodiment, the unit cell includes a number of three-dimensional structures. In some embodiments, the unit cell includes a portion of a number of three-dimensional structures.

In some embodiments, the article is a fixed abrasive article for modifying the surface of a wafer suited for fabrication of semiconductor devices and further includes a plurality of fixed abrasive structures located in a predetermined arrangement in a region of the article, the region being of a dimension sufficient to planarize the surface of a wafer suited for fabrication of semiconductor devices.

In another embodiment, the region includes at least about 10 structures/linear cm, at least about 50 structures/linear cm, or at least about 500 structures/linear cm.

In some embodiments, the three-dimensional structures are uniformly distributed in the region. In other embodiments, the three-dimensional structures are arranged in a pattern having a repeating period. In one embodiment, at least some of the three-dimensional structures are located in clusters.

In one embodiment, the three-dimensional structures further include a binder and abrasive particles disposed in the binder. In other embodiments, the three-dimensional structures are essentially free of inorganic abrasive particles. In an embodiment, the three-dimensional structures are essentially free of components reactive with a wafer.

In some embodiments, the three-dimensional structures are of a form selected from the group consisting of cubic posts, cylindrical posts, rectangular posts, prismatic, pyramidal, truncated pyramidal, conical, truncated conical, cross, hemispherical and combinations thereof. In one embodiment, the three-dimensional structures include a pyramidal form having sides of varying slope relative to the base of the pyramid. In another embodiment, substantially all of the three-dimensional structures have the same shape and dimensions.

In some embodiments, the three-dimensional structures are located on a polishing element and the article further includes a) a resilient element and b) a rigid element disposed between the polishing element and the resilient element. In another embodiment, the rigid element is bonded to the polishing element and the resilient element.

In one embodiment, the method includes planarizing the surface of the wafer suited for fabrication of semiconductor devices. In another embodiment, the method includes planarizing a metal surface (e.g., copper) of a wafer suited for fabrication of semiconductor devices. In other embodiments, the method includes planarizing a dielectric surface of a wafer suited for fabrication of semiconductor devices. In some embodiments, the method is substantially free of audible vibration.

In some embodiments, the method is conducted in the absence of inorganic abrasive particles. In other embodiments, the polishing composition includes abrasive particles. In another embodiment, the polishing composition is essentially free of abrasive particles.

In one embodiment, the method further includes removing at least about 500 Angstroms of material/minute from the surface of at least one wafer for a period of at least about 200 minutes. In other embodiments, the method further includes removing at least about 500 Angstroms of material/minute from the surface of at least one wafer and providing wafers having no greater than about 10% wafer non-uniformity.

In another embodiment, the structures include elongated prismatic structures. In another embodiment, the structures include elongated ridges.

In another aspect, the invention features a method of chemically modifying a wafer suited for fabrication of semiconductor devices and the method includes a) contacting the surface of the wafer with an article that includes a number of unit cells repeating across the surface of the article, the individual unit cells including at least a portion of a three-dimensional structure and being characterized by a unit cell parameter $[[V_1-Vs]/Aas]/\sqrt{Auc}>1$, where $V_1$ is the volume defined by the area of the unit cell and the height of the structure of the unit cell, Vs is the volume of the structure of the unit cell, Aas is the apparent contact area of the structure of the unit cell, and Auc is the area of the unit cell, the three-dimensional structure being essentially free of inorganic abrasive particles, and b) moving at least one of the wafer and the article relative to each other in the presence of a polishing composition that is chemically reactive with the surface of the wafer and capable of either enhancing or inhibiting the rate of removal of at least a portion of the surface of the wafer.

In other aspects, the invention features an article for modifying the surface of a wafer suited for fabrication of semiconductor devices and the article includes a) a first element having a plurality of unit cells repeating across the surface of the article, the individual unit cells including at least a portion of a three-dimensional structure and being characterized by a unit cell parameter $[[V_1-Vs]/Aas]/\sqrt{Auc}>1$, where $V_1$ is the volume defined by the area of the unit cell and the height of the structure of the unit cell, Vs is the volume of the structure of the unit cell, Aas is the apparent contact area of the structure of the unit cell, and Auc is the area of the unit cell, the three-dimensional structure being essentially free of inorganic abrasive particles, b) a relatively more resilient element, and c) a relatively more rigid element disposed between the first element and the resilient element.

In some embodiments, the three-dimensional structure is capable of contributing to the chemical modification of the surface of a wafer suited for fabrication of semiconductor devices. In one embodiment, the article is in the form of a web. In other embodiments, the article is in the form of a circular polishing pad.

In one aspect, the invention features an article that is suitable for use in chemical mechanical planarization processes and that includes an element that includes a number of unit cells repeating across the surface of the article, the individual unit cells including at least a portion of a three-dimensional structure that is essentially free of inorganic abrasive particles and is capable of contributing to the chemical modification of a surface of a wafer suited for fabrication of semiconductor devices, the unit cell is characterized by a unit cell parameter $[[V_1-Vs]/Aas]/\sqrt{Auc}>1$, where $V_1$ is the volume defined by the area of the unit cell and the height of the structure of the unit cell, Vs is the volume of the structure of the unit cell, Aas is the apparent contact area of the structure of the unit cell, and Auc is the area of the unit cell. In some embodiments, the article further includes a relatively more resilient element, and a relatively more rigid element disposed between the relatively more resilient element and the first element.

In another aspect, the invention features an article that includes an element that includes a plurality of unit cells repeating across the surface of the article, the individual unit cells including at least a portion of a three-dimensional structure and being characterized by a unit cell parameter as follows:

$$[[V_1-Vs]/Aas]/\sqrt{Auc}>5$$

where $V_1$ is the volume defined by the area of the unit cell and the height of the structure of the unit cell, Vs is the volume of the structure of the unit cell, Aas is the apparent contact area of the structure of the unit cell, and Auc is the area of the unit cell. In some embodiments, the three-dimensional structures include abrasive particles. In other embodiments, the three-dimensional structures are capable of contributing to the chemical modification of a surface of a wafer suited for fabrication of semiconductor devices. In one embodiment, the article further includes a relatively more resilient element and a relatively more rigid element disposed between the relatively more resilient element and the first element.

In another embodiment, the article is capable of removing at least about 500 Angstroms of material/minute from a wafer suited for fabrication of semiconductor devices for a period of at least about 200 minutes. In other embodiments, the article is capable of removing at least about 500 Angstroms of material/minute from surfaces of a plurality of wafers suited for fabrication of semiconductor devices and providing wafer surfaces having no greater than about 10% wafer non-uniformity. In some embodiments the article is in the form of a web. In other embodiments, the article is in the form of a circular polishing pad.

The term "unit cell" refers to the smallest unit of repeat of a two dimensional array of structures that tiles the plane of an article for modifying the surface of a wafer suited for fabrication of semiconductor devices. The unit cell is analogous to the unit cell of the crystallographic arts. The unit cell may require translation, rotation, reflection across a line or a point, and combinations thereof to tile the plane. There may be more than one unit cell that tiles the plane. In FIG. 1, for example, the smallest unit of repeat that tiles the plane of the article is a triangle. For purposes of this invention, an exception to the unit cell definition set forth above arises in the case of articles that include elongated parallel structures, i.e., structures having a greater length dimension than width dimension such that the ratio of the length dimension to the width dimension is at least 2:1 arranged parallel to each other. For articles that include elongated parallel structures, the unit cell is arbitrarily set as a square of the sum of the width of the structure plus the width of the spacing between the structures, i.e., the length dimension is arbitrarily selected to be equal to the sum of the width dimension of the structure plus the width dimension of the space between adjacent structures.

The phrase "apparent contact area" refers to the area of the top surface of an entity, e.g., a structure or a polishing pad, that appears to be capable of contacting a surface of a wafer suited for fabrication of semiconductor devices when the two entities are in contact with each other under some applied load. The actual area that contacts the surface of a wafer suited for fabrication of semiconductor devices, i.e., the real area of contact, is thought to be less than the apparent contact area.

The phrase "% apparent bearing area" refers to the area on an article that constitutes the apparent contact area relative to the total planar area within a region of the article that is of a dimension suitable for planarizing the surface of a wafer suited for fabrication of semiconductor devices.

Polishing pads having unit cells that satisfy the equation $[[V_1-Vs]/Aas]/\sqrt{Auc}>5$ provide a sufficient amount of polishing composition to the surface of the wafer for a sufficient an amount of time to allow chemical reactions to occur at the surface of the wafer. The polishing pads also provide a number of surface wipes per unit time (i.e., the number of times the surface of the wafer is wiped with a structure from the polishing pad) sufficient to remove the spent chemistry, and other reaction by products, from the surface of the wafer and to expose a fresh surface for reaction. The polishing pad also provides good fluid flow and a sufficient volume of polishing composition such that fresh polishing composition is available for contact with the surface of the wafer during polishing operations.

The polishing pad also appears to transfer relatively lower total frictional forces to the carrier, exhibits good removal rate stability and provides good temperature control during polishing processes. In some embodiments, the polishing pad exhibits shorter pad break in times due to the decreased amount of apparent contact area that must be modified initially. In some embodiments, the polishing pads can provide reproducible removal rates for extended periods of polishing time.

Other structures of the invention will be apparent from the following description of preferred embodiments thereof, and from the claims.

DETAILED DESCRIPTION

The method of chemically modifying a wafer suited for fabrication of semiconductor devices includes a) contacting a surface of the wafer with an article and b) moving the wafer and the article relative to each other in the presence of a polishing composition capable of chemically reacting with the wafer and either enhancing or inhibiting the rate of removal of at least a portion of the wafer surface to be modified. The method of modifying can include, e.g., planarizing, polishing and combinations thereof. The wafer surface may include, e.g., metal, dielectric and combinations thereof.

Figure 1:
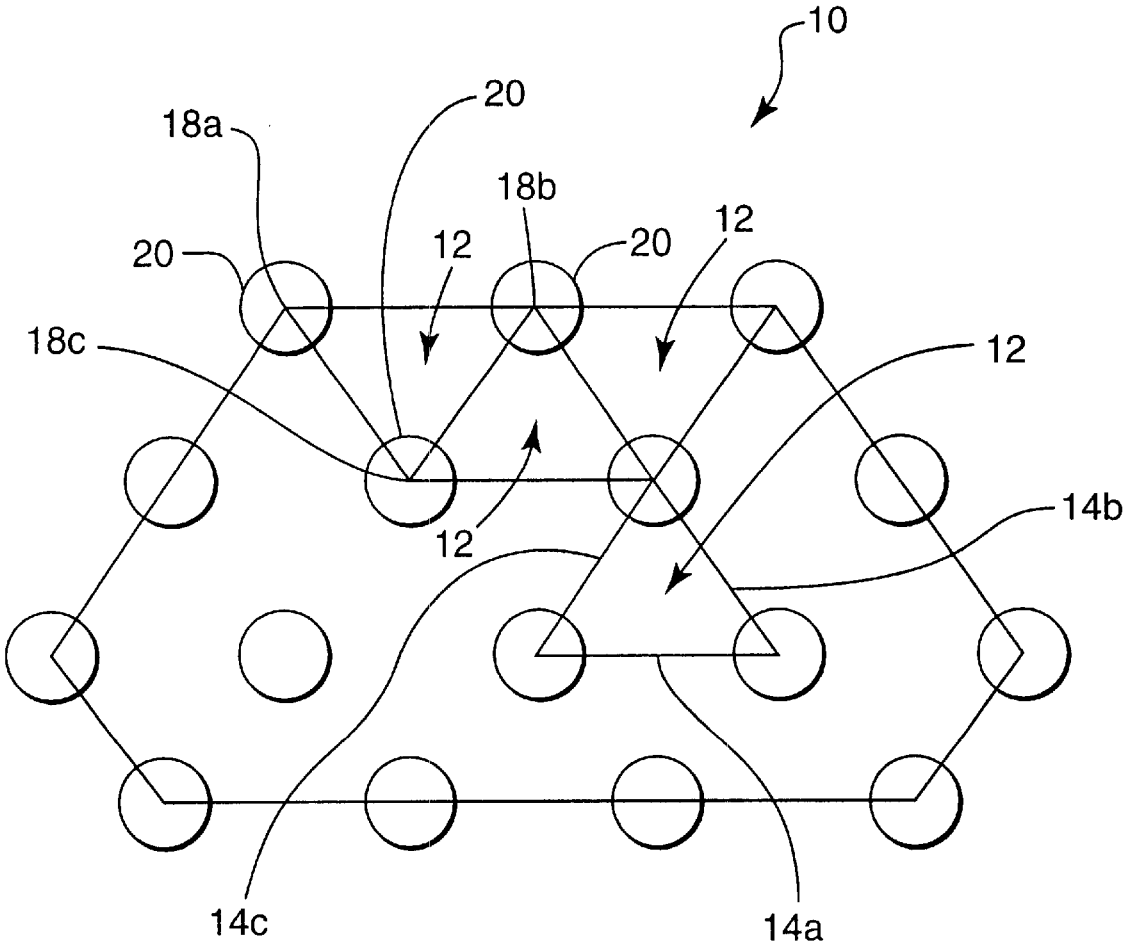
FIG. 1 is a top view depicting unit cells of an article for polishing a wafer suited for fabrication of semiconductor devices.

The article includes a number of unit cells repeating across the surface of the article. FIG. 1 shows one embodiment of a wafer polishing article 10 that includes a triangular unit cell 12 defined by lines 14*a,* 14*b* and 14*c* and cylindrical post structures 20. Points 18*a,* 18*b* and 18*c* of the triangular unit cell 12 are located in the center of the cylindrical posts 20 such that the unit cell includes a portion of three cylindrical posts 20. The triangular unit cells 12 tile the plane of the article 10.

Figure 2:
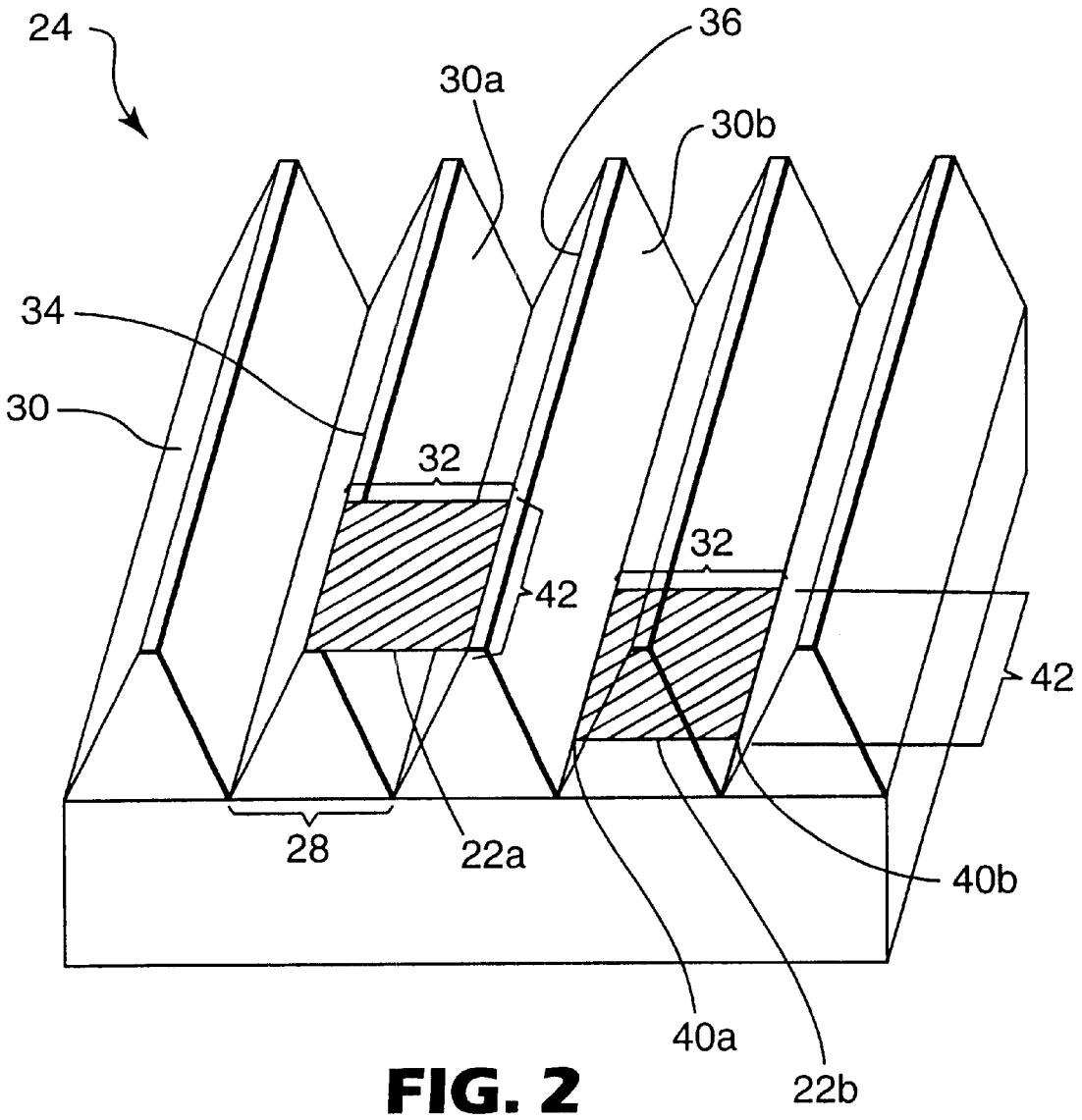
FIG. 2 is a perspective view depicting the unit cell of a second embodiment of an article for polishing a wafer suited for fabrication of semiconductor devices that includes truncated prismatic structures.

FIG. 2 illustrates the square unit cells 22 of a wafer polishing article 24 that includes truncated elongated prismatic structures 30. Each unit cell 22 is defined by the width 28 of the structure 30, which can be taken as either the distance 32 from the far edge 34 of a first structure 30*a* to the leading edge 36 of an adjacent second structure 30*b,* as illustrated by unit cell 22*a,* or the distance 32 from the first base edge 40*a* to the opposite base edge 40*b,* as illustrated by unit cell 22*b.* The longitudinal dimension 42 of the unit cell 22 is selected to be equal to the width 28 of the structure 30. The square unit cells 22 tile the plane of the article 24.

Figure 3:
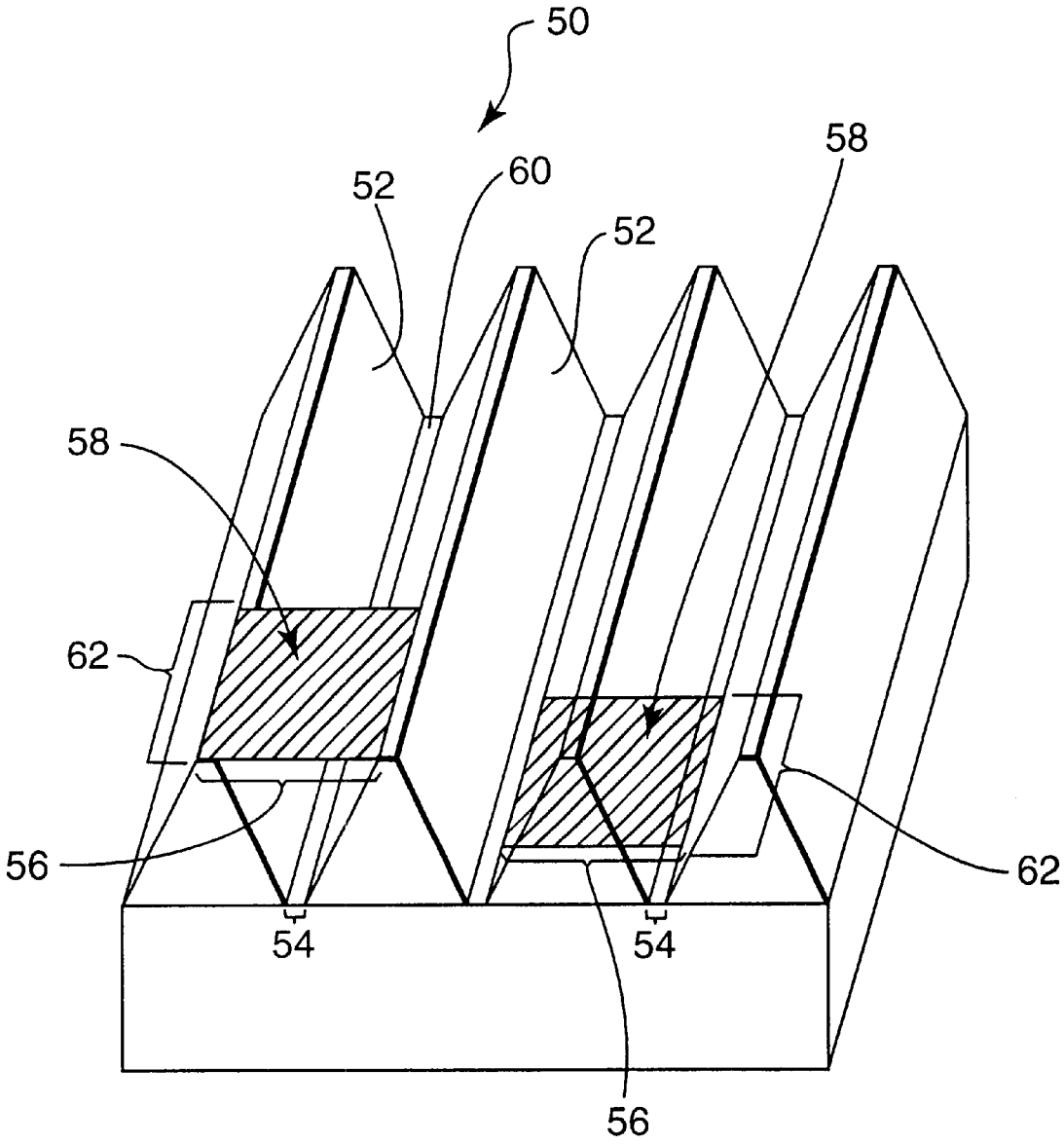
FIG. 3 is a perspective view depicting the unit cell of a third embodiment of an article for polishing a wafer suited for fabrication of semiconductor devices that includes truncated prismatic structures.

FIG. 3 illustrates a wafer polishing article 50 that includes adjacent truncated elongated prismatic structures 52 spaced apart from each other by a distance 54. The width dimension 56 of the unit cell 58 includes the space 60 between two adjacent elongated prismatic structures 52 and the width 56 of the elongated prismatic structure 52. The longitudinal dimension 62 of the unit cell 58 is selected to be equal to the width dimension 56 of the structure 52 plus the space 60.

The individual unit cell includes at least a portion of a three-dimensional structure and is characterized by a unit cell parameter as follows: $[[V_1-Vs]/Aas]/\sqrt{A}uc$. Preferably the unit cell parameter, i.e., the result of the calculation $[[V_1-Vs]/Aas]/\sqrt{A}uc$, is greater than 5, preferably at least about 10, more preferably at least about 15, most preferably at least about 20. $V_1$ is the volume defined by the area of the unit cell and the height of the three-dimensional structure of the unit cell. Vs is the volume of the three-dimensional structure of the unit cell. For articles in which the unit cell includes a portion of a structure, Vs is the volume of that portion of the structure. For articles in which the unit cell includes a portion of a number of structures, Vs is the sum of the volume of those portions, and when the unit cell includes a number of structures, Vs is the sum of the volume of those structures. Aas is the apparent contact area of the structure of the unit cell. Auc is the area of the unit cell. $\sqrt{A}uc$ is the square root of the area of the unit cell and approximates the spacing between the structures of adjacent unit cells; preferably $\sqrt{A}uc$ is from 15 $\mu$m to 2000 $\mu$m.

Without wishing to be bound by theory, the inventors believe that the presence of flow channels, optimization of the unit cell volume and optimization of the free volume of the unit cell, i.e., $[V_1-Vs]$, such that $[[V_1-Vs]/Aas]/\sqrt{A}uc>5$, optimizes the provision of fresh chemistry to the surface of the wafer and removal, from the wafer surface, of spent chemistry and other by products of the reaction between the polishing composition and the surface of the wafer. It is further believed that optimizing the free volume of the unit cell, in turn, optimizes the spacing and depth of the flow channels such that the polishing composition remains mobile on the surface of the polishing pad, i.e., the polishing composition does not stagnate in the channels.

The article is preferably capable of providing a removal rate of at least about 500 Å of material/minute, more preferably at least about 2000 Å of material/minute, most preferably at least about 6000 Å of material/minute. The removal rate is the rate at which the layer that is being modified (e.g., planarized) is removed from the wafer. The removal rate is determined by measuring the change in thickness of the layer being modified from the initial (i.e., before modifying) thickness to the final (i.e., after modifying) thickness. In some embodiments, the article is capable of providing a removal rate that is substantially constant from wafer to wafer, i.e., the wafer to wafer % non-uniformity is less than 10%. The article can be constructed to provide a removal rate that is constant over a polishing period of at least 200 minutes, preferably at least about 500 minutes, more preferably at least about 700 minutes, most preferably at least about 800 minutes.

The article is also capable of modifying a wafer layer such that the modified layer of the wafer exhibits low % non-uniformity, i.e., the % wafer non-uniformity. Preferably the article produces a modified wafer surface having no greater than about 10% non-uniformity, more preferably no greater than about 5% non-uniformity, most preferably no greater than 2% non-uniformity.

The individual unit cell includes at least a portion of a three-dimensional structure and may also include a portion of a number of three-dimensional structures, a single three-dimensional structure, a number of three-dimensional structures including, e.g., a cluster, and combinations thereof. In the case of elongated three-dimensional structures, for example, the unit cell includes a portion of the elongated three-dimensional structure. It is to be understood that the three-dimensional structure(s) present in an individual unit cell may exhibit minor variations in at least one dimension relative the three-dimensional structure(s) present in other unit cells on the article and that the unit cell parameter refers to the average unit cell parameter of the article.

The three-dimensional structures extend from a base of the article and terminate in a continuous top surface. Preferably the top surface of an individual structure is planar. In some embodiments, the three-dimensional structure is a continuous elongated structure having a continuous top planar surface, e.g., prismatic structures and elongated ridges. Structures that initially have other than a top planar surface can be made planar with a relatively short period of preconditioning. The apparent contact area of an individual three-dimensional non-elongated structure is preferably from 0 $\mu m^2$ (i.e., a point) to 200,000 $\mu m^2$, preferably from 1 $\mu m^2$ to 200,000 $\mu m^2$, more preferably from 5 $\mu m^2$ to 200,000 $\mu m^2$. The top surface of an individual structure preferably has an area defined by at least one dimension that is from 1 $\mu$m to less than 500 $\mu$m, more preferably from 1 $\mu$m to about 200 $\mu$m. The surface area of the top planar surface of an individual structure on an article having many structures, i.e., the top planar surface of the article is discontinuous, preferably represents no greater than $1/50^{th}$, more preferably no greater than about $1/10{,}000^{th}$ most preferably no greater than about $1/100{,}000{,}000^{th}$ of the nominal area available for contact with a wafer in any region on the article that is suitable for planarizing the surface of a wafer.

The article can include from about 1 structure per linear cm to about 500 structures per linear cm, preferably at least about 10 structures per linear cm, more preferably at least about 50 structures per linear cm, most preferably from about 50 structures per linear cm to about 500 structures per linear cm. The number and spacing of the structures can be varied relative to the structure size to achieve a desired planarization effect and to achieve the desired apparent contact area. The distribution of the structures may be uniform or may include clusters of relatively closely spaced structures.

The article preferably includes at least about 10 structures/$cm^2$, preferably at least about 100 structures/$cm^2$, more preferably at least about 5000 structures/$cm^2$.

The tops of the structures preferably lie in substantially the same plane. The useful height of the structures, i.e., that portion of the structure that is suitable for use in a wafer planarization process, is preferably from 10 $\mu$m to about 500 $\mu$m.

The structures are preferably located in a predetermined arrangement on the surface of the article such that a unit cell can be defined. That is, the structures are provided at predetermined locations. The arrangement of the structures can be predetermined based upon, e.g., the arrangement of cavities or protrusions in the production tool from which the structures are generated. For an article made by providing a slurry between a backing and a production tool having cavities therein, for example, the predetermined pattern of the structures will correspond to the pattern of the cavities on the production tool. The pattern can be reproducible from article to article. The structures are preferably arranged in a repeating pattern.

Useful structures can be precisely shaped or irregularly shaped. An article can also include a combination of precisely shaped structures and irregularly shaped structures. Suitable structures shapes include, e.g., cubic, cylindrical posts, prismatic, rectangular cross-section posts, pyramidal, truncated pyramidal, conical, truncated conical, cross, post-like with a top surface that is substantially flat, hemispherical as described in, e.g., WO 95/224,436, and combinations thereof. The structures can also include pyramids having sides of varying slope relative to the base of the pyramid. FIGS. 9–12 illustrate examples of three-dimensional structures in the form of truncated pyramids, crosses, hexagonal posts and cylindrical posts, respectively.

The structures can include sides that are perpendicular relative to the plane of the base of the structures, sides that taper with increasing width toward the plane of the base of the structures, and combinations thereof. For structures prepared from a cavity production tool, examples of which are described in more detail below, if the sides of the structures are tapered, the structures or sheet of structures is easier to remove from the tool. The angle forming the taper, as measured from the interior of the structure base to the structure wall, can range from about 1 to 89 degrees, preferably from about 2 to 80 degrees, more preferably from about 10 to 75 degrees, most preferably from about 25 to 60 degrees.

In the case of pyramids or truncated pyramids, the pyramidal shape can include at least three sides, and preferably has four to five sides if untruncated and five to six sides if truncated. The pyramids and truncated pyramids can also include a base side. Where a pyramidal or truncated pyramidal shape is used as the composite shape, the sides of the base side may have a length of from about 50 to about 5000 $\mu$m.

The structures are preferably three-dimensional abrasive composites as described in, e.g., U.S. Pat. Nos. 5,958,794 and 5,152,917, and incorporated herein.

In another embodiment, the structures are elongated, e.g., elongated prisms and elongated ridges, and arranged parallel to each other. The elongated structures are separated at their distal ends and may be abutted or separated at the side of the elongated structure that is attached to a backing of the polishing article. Adjacent structures may be completely separated near both the distal end and the attachment end such that the backing is exposed in-between the elongated structures.

Figure 6:
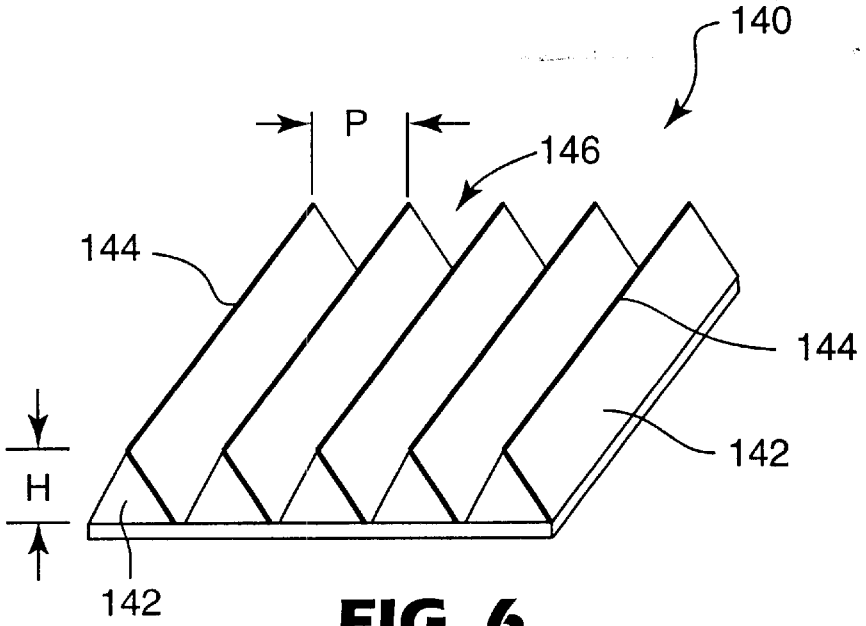
FIG. 6 is a perspective view of a sixth embodiment of an article for polishing a wafer suited for fabrication of semiconductor devices that includes prismatic structures.

The spacing or pitch between the elongated structures, whether continuous or intermittent, as measured from one point of one elongated structure to that of the adjacent or nearest elongated structure, indicated as "p" in FIG. 6, is selected to be a uniform value through any particular array. For purposes of this disclosure, an adjacent elongated structure means a first elongated structure that faces a second elongated structure over a common groove without any intervening elongated structures located therebetween. The pitch "p" generally is set as a value from about 3 to about 500 um, more preferably from about 1 to about 150 um, most preferably from about 1 to about 50 um.

The base of the article may be a unitary structure that includes the three-dimensional structures of the polishing article. Such a base results, e.g., when molding the plurality of three-dimensional structures using a production tool with a plurality of cavities. The base may be of the same composition as the three-dimensional structures. When the polishing article is formed from a production tool with a number of cavities, each three-dimensional structure can be defined by a boundary, the base portion of the boundary being the interface with the backing to which the structures are adhered. The remaining portion of the boundary is defined by the cavity on the surface of the production tool in which the structure was cured. The entire outer surface of the three-dimensional structure is confined either by the backing or the cavity during its formation.

Recessed regions exist between the three-dimensional structures. These recessed regions can be in the form of channels that assist in the distribution of the polishing composition over the entire surface of a wafer suited for fabrication of semiconductor devices when carrying out a chemical mechanical planarization process. The recessed regions can also act as channels to help remove the spent chemistry and other debris from the wafer surface. Preferably the channels are continuous. The channels can also be formed as the result of grooves formed on the surface of the article or by removing or omitting at least one row of structures on a polishing article that includes multiple rows.

The article can include a backing having attached to at least one major surface thereof, the predetermined arrangement of three-dimensional structures. Suitable backings include, e.g., polymeric film (e.g., polyester), paper, cloth, metallic film, vulcanized fiber, nonwoven substrates and combinations thereof, and treated versions thereof. In some cases, it is useful to have a backing that is transparent to ultraviolet radiation. The backing can also be primed with a material to promote adhesion of the microstructure element to the backing.

The structures include a polymer and, optionally, abrasive particles. The polymer of the three-dimensional structures or the binder, in the case of abrasive structures, can be used to bond the structures to the backing, when present. Useful polymers include, e.g., thermoplastic polymers, thermoset polymers, and mixtures thereof. Other useful polymers are described in U.S. Pat. No. 5,958,794 and U.S. patent application Ser. No. 09/328,916 entitled, "Method of Modifying a Surface," filed Jun. 9, 1999, and incorporated herein.

When present, abrasive particles may be distributed homogenously or non-homogeneously throughout the polymer composition, i.e., the binder, to form abrasive structures. The abrasive structures can be fixed in place on the article.

The size of useful abrasive particles can vary from about 0.001 $\mu$m to about 1000 $\mu$m. For semiconductor wafer planarization, fine abrasive particles are preferred. The average particle size of the abrasive particles preferably is from 0.001 $\mu$m to 50 $\mu$m, more preferably from 0.01 $\mu$m to 10 $\mu$m. For planarization of metal surfaces the average particle size is preferably from 0.005 $\mu$m to 1 $\mu$m, more preferably from 0.01 $\mu$m to 0.5 $\mu$m. For planarization of a metal oxide-containing layer (e.g., a silicon dioxide containing layer) the particle size is preferably less than about 1 $\mu$m, more preferably less than about 0.5 $\mu$m. The size distribution of the particles can be relatively more tightly controlled where desired and can be selected to produce a desired surface finish.

Suitable abrasive particles include inorganic abrasive particles. Examples of useful abrasive particles include fused aluminum oxide, heat treated aluminum oxide, white fused aluminum oxide, black silicon carbide, green silicon carbide, titanium diboride, boron carbide, silicon nitride, tungsten carbide, titanium carbide, diamond, cubic boron nitride, hexagonal boron nitride, garnet, fused alumina zirconia, alumina-based sol gel derived abrasive particles and mixtures thereof. Alumina based sol gel derived abrasive particles are described in, e.g., U.S. Pat. Nos. 4,314,827, 4,623,364, 4,744,802, 4,770,671 and 4,881,951, and incorporated herein. Other examples of suitable inorganic abrasive particles include silica, iron oxide, chromia, ceria, zirconia, titania, tin oxide, gamma and other transition phases of alumina, and mixtures thereof.

Other useful particles are described in U.S. Pat. No. 5,958,794 and incorporated herein.

The hardness and size of the particles are selected to achieve a desired removal rate and surface finish for the surface being planarized.

The abrasive particles may also be in the form of an abrasive agglomerate that includes a number of individual abrasive particles bonded together to form a unitary particulate mass. The abrasive agglomerates may be irregularly shaped or have a predetermined shape. The abrasive agglomerate may utilize an organic binder or an inorganic binder to bond the abrasive particles together. Abrasive agglomerates preferably have a particle size less than about 100 um, more preferably less than about 50 um, most preferably less than about 25 um. Examples of abrasive agglomerates are further described in U.S. Pat. Nos. 4,652,275, 4,799,939 and 5,500,273, and incorporated herein.

The abrasive particles preferably are resistant to the polishing composition such that their physical properties do not substantially degrade upon exposure to the polishing composition.

In some embodiments, the three-dimensional structures include abrasive particles that are reactive with the surface of the wafer. Such abrasive particles include, e.g., cerium oxide.

The abrasive structures can be formed from a slurry that includes a mixture of abrasive particles dispersed in an uncured or ungelled binder, e.g., a binder precursor. The slurry can include from about 1 part by weight to 90 parts by weight abrasive particles and 10 parts by weight to 99 parts by weight binder, more preferably from about 30 parts by weight to 85 parts by weight abrasive particles and 15 parts by weight to 70 parts by weight binder, most preferably from about 40 parts by weight to about 70 parts by weight abrasive particles and about 30 parts by weight to about 60 parts by weight binder precursor.

The binder precursor has a phase that is capable of flowing sufficiently so as to be coatable and then solidifying. The solidification can be achieved by curing, e.g., polymerizing, crosslinking and combinations thereof, by drying (e.g., by driving off a liquid), cooling, and combinations thereof. The precursor composition can be organic solvent-borne, water-borne, or 100% solids (i.e., substantially carrier-free). Thermosetting components, thermoplastic components and combinations thereof can be used as the binder precursor.

The binder precursor is preferably a curable organic material (i.e., a material capable of polymerizing, crosslinking or a combination thereof upon exposure to an energy source including, e.g., heat, radiation, e.g., E-beam, ultraviolet, visible, or a combination thereof, and with time upon the addition of a chemical catalyst, moisture, and combinations thereof.

Suitable binder precursors include amino resins (e.g., aminoplast resins) including e.g., alkylated urea formaldehyde resins, melamine-formaldehyde resins, and alkylated benzoguanamine-formaldehyde resin, acrylate resins (e.g., acrylates and methacrylates) including, e.g., vinyl acrylates, acrylated epoxies, acrylated urethanes, acrylated polyesters, acrylated acrylics acrylated polyethers, vinyl ethers, acrylated oils and acrylated silicones, alkyd resins such as urethane alkyd resins, polyester resins, reactive urethane resins, phenolic resins such as resole and novolac resins, phenolic/latex resins, epoxy resins such as bisphenol epoxy resins, isocyanates, isocyanurates, polysiloxane resins including, e.g., alkylalkoxysilane resins, reactive vinyl resins. The resins may be in the form of monomers, oligomers, polymers and combinations thereof. Examples of suitable binder precursors are described in, e.g., U.S. Pat. No. 5,958,794 and incorporated herein.

The binder composition can also include other components including, e.g., plasticizers, initiators, abrasive particle surface modification additives, coupling agents, fillers, expanding agents, fibers, anti-static agents, suspending agents, lubricants, wetting agents, surfactants, pigments, dyes, UV stabilizers, complexing agents, chain transfer agents, accelerators, catalysts and activators.

Another type of composition suitable for use in preparing abrasive structures is a ceramer. Suitable ceramers are disclosed in, e.g., U.S. Pat. Nos. 5,391,210 and 5,958,794, and incorporated herein. Useful methods of making ceramer precursors and ceramer compositions are disclosed in, e.g., U.S. Pat. No. 5,958,794 and incorporated herein.

The article for polishing the surface of a wafer can be in a variety of forms including, e.g., a web, a disc, e.g., in the form of an abrasive disc, and an endless belt. The article may also be in the form of an oval, a polygonal shape including, e.g., triangular, square, rectangular, heptagonal, and hexagonal.

Useful articles may also be in the form of a web capable of being rolled up upon itself. In use, the article in web form can be unwound from, wound onto a roller and combinations thereof and indexed to achieve the desired planarization criteria. Indexing may occur during planarization of a wafer suitable for fabrication of semiconductor devices, between wafers and in combinations thereof. The web can also be indexed in increments such that after polishing a given number of wafers and indexing the web after each wafer polishing process, an equilibrium % apparent bearing area exists across the polishing surface of the web. The equilibrium % apparent bearing area in essence exposes each wafer to the same polishing surface, which can enhance the reproducibility and uniformity of the polishing operation from wafer to wafer.

The web can have a thickness that is much thinner than the web width to enable the web to be rolled up for ease of storage and transport.

The article can be made according to a variety of methods including, e.g., the replication methods for making fixed abrasive articles described in U.S. Pat. No. 5,958,794, and the methods disclosed in U.S. Pat. Nos. 5,152,917 and 5,435,816, all of which are incorporated herein. Other descriptions of suitable methods are disclosed in U.S. Pat. Nos. 5,437,754, 5,454,844, 5,437,543, 5,435,816 and 5,304,223, and incorporated herein.

One useful method of making the article includes preparing a slurry that includes abrasive particles and binder precursor, providing a production tool having a front surface and having a number of cavities that extend from the front surface, introducing the slurry into the cavities of the production tool, introducing a backing to the front surface of the production tool such that the slurry wets one major surface of the backing to form an article, at least partially curing or gelling the binder precursor before the article departs from the outer surface of the production tool, and removing the article from the production tool to form an article that includes structures in a predetermined arrangement bonded to a backing. The binder precursor may optionally be further cured after removing the article from the production tool.

The article can be used in stationary processes as well as continuous and semi-continuous processes.

Figure 13:
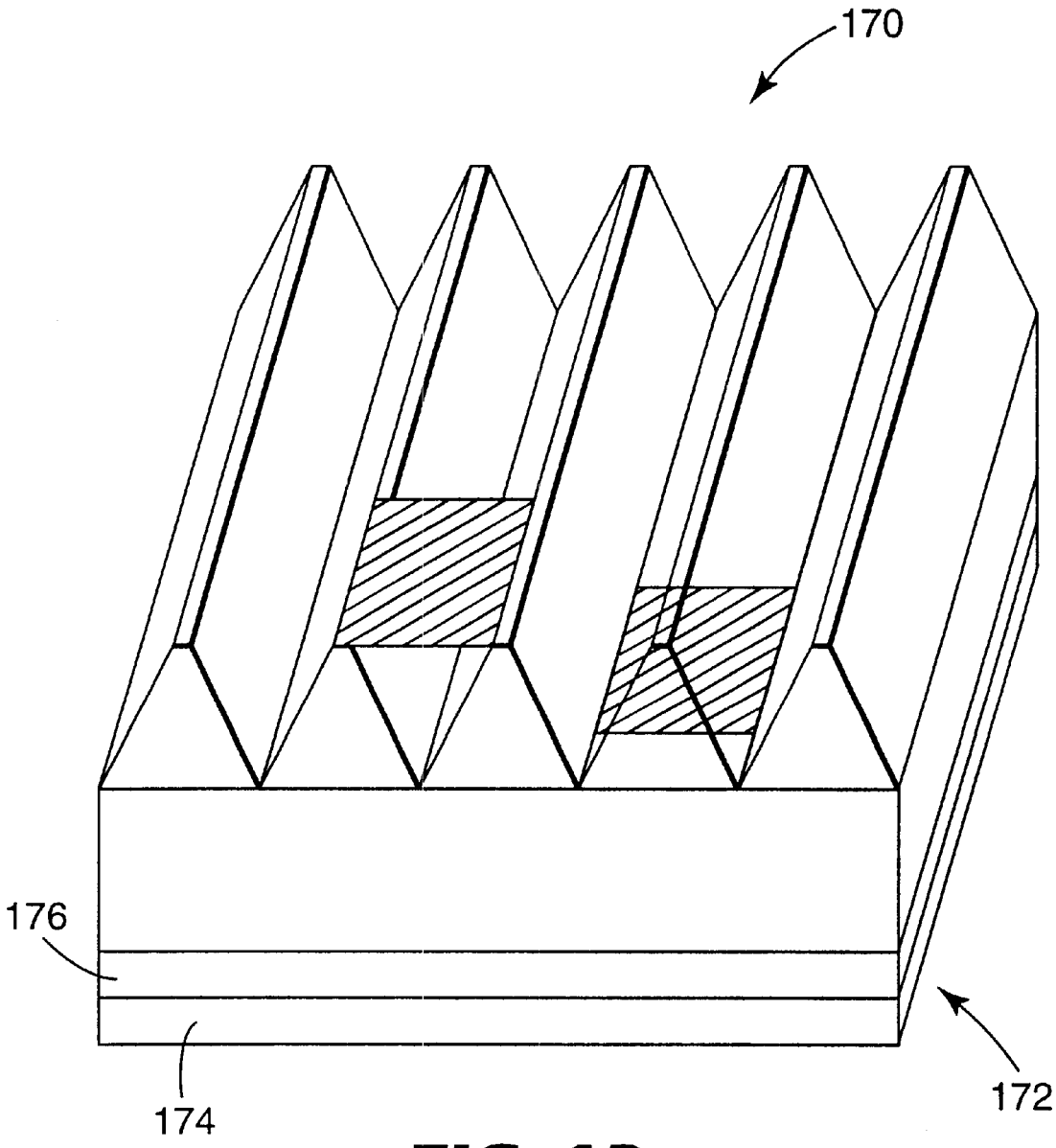
FIG. 13 is a perspective view of a ninth embodiment of an article for polishing a wafer suited for fabrication of semiconductor devices that includes a rigid element and a resilient element.

In another embodiment, as shown in FIG. 13, the above-described article is a polishing element 170 and the article construction further includes a subpad 172 that includes a relatively more resilient, i.e., lower modulus, element 174, and a relatively more rigid, i.e., higher modulus, element 176 disposed between the resilient element and the polishing element. Typically, the modulus of the resilient element (i.e., the Young's Modulus in the thickness direction of the material) is at least about 25%, preferably at least about 50% less than the modulus of the rigid element. Preferably the rigid element has a Young's modulus of at least about 100 Mpa and the resilient element has a Young's Modulus of less than about 100 Mpa, more preferably the Young's Modulus of the reslient element is less than about 50 Mpa.

The rigid and resilient elements can be bonded to each other and the rigid element can be bonded to the polishing element.

Figure 4:
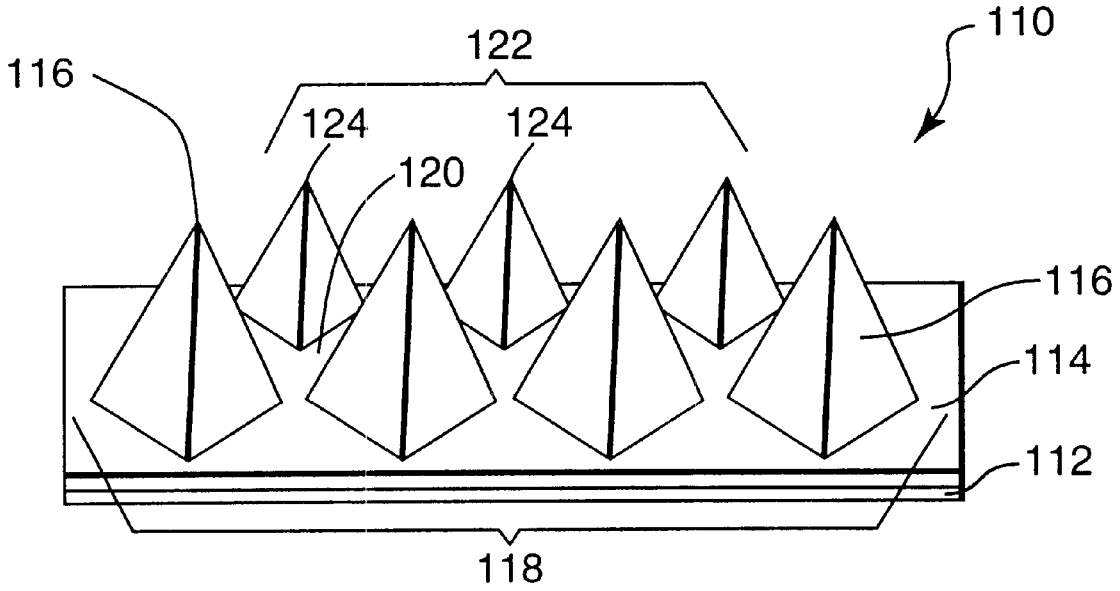
FIG. 4 is a perspective view of a fourth embodiment of an article for polishing a wafer suited for fabrication of semiconductor devices that includes trigonal pyramidal structures.

Additional article configurations are shown in FIGS. 4–8. Referring to FIG. 4, the article 110 includes a backing 112 to which the base 114 (e.g., a continuous layer of the composition of the structures or a priming layer of a different composition) of the three-dimensional structures 116 is bonded. The structures 116 are four sided pyramids (including the base side) arranged in rows 118. There are recessed regions 120, e.g., valleys, between adjacent structures 116. The second row 122 of pyramidal structures 116 is offset from the first row 118. The outermost point 124 or distal end 124 of the structure 116 contacts the wafer suited for fabrication of semiconductor devices during planarization.

Figure 5:
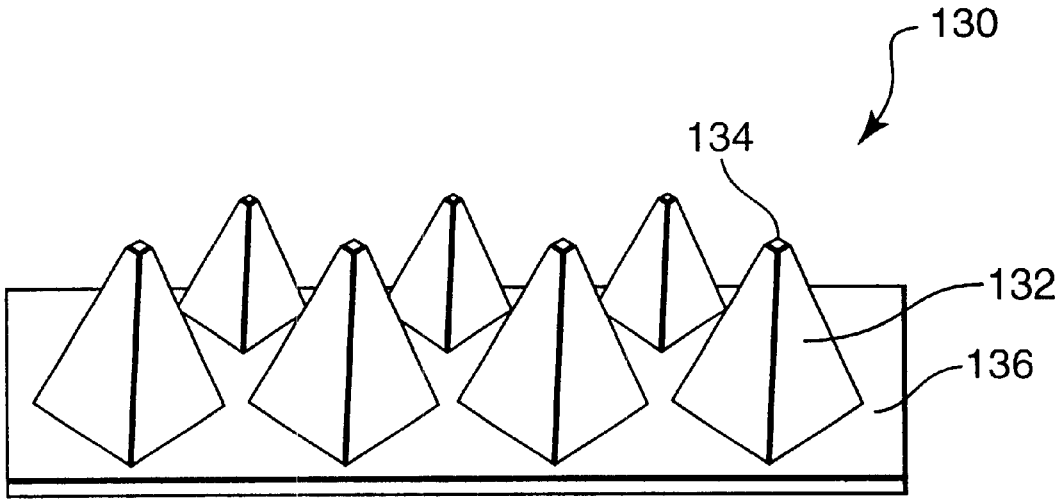
FIG. 5 is a perspective view of a fifth embodiment of an article for polishing a wafer suited for fabrication of semiconductor devices that includes truncated pyramidal structures.

FIG. 5 shows an article 130 that includes three-dimensional structures 132 extending from a base 136 in the form of truncated pyramids. The top planar surface 134 of the truncated pyramidal structure 132 is available for contact with a wafer during planarization.

FIG. 6 depicts an embodiment of the article 140 that includes a number of elongated prismatic structures 142 separated by continuous recessed regions 146, i.e., channels. The top surfaces 144 of structures 142 are available for contact with a wafer during planarization. The points of the prismatic structures 142 may become worn away during use of the polishing article 40 to form a truncated prismatic structure.

Figure 7:
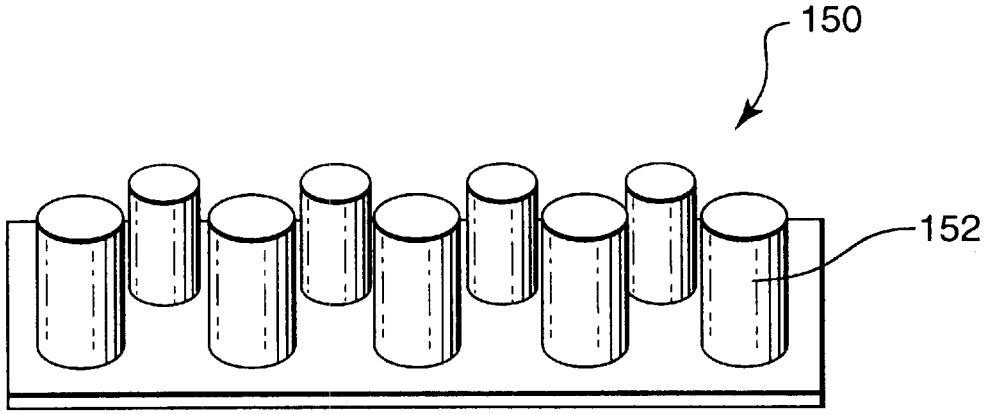
FIG. 7 is a perspective view of a seventh embodiment of an article for polishing a wafer suited for fabrication of semiconductor devices that includes cylindrical structures.

FIG. 7 illustrates another embodiment of the article 150 that includes cylindrical structures 152.

Figure 8:
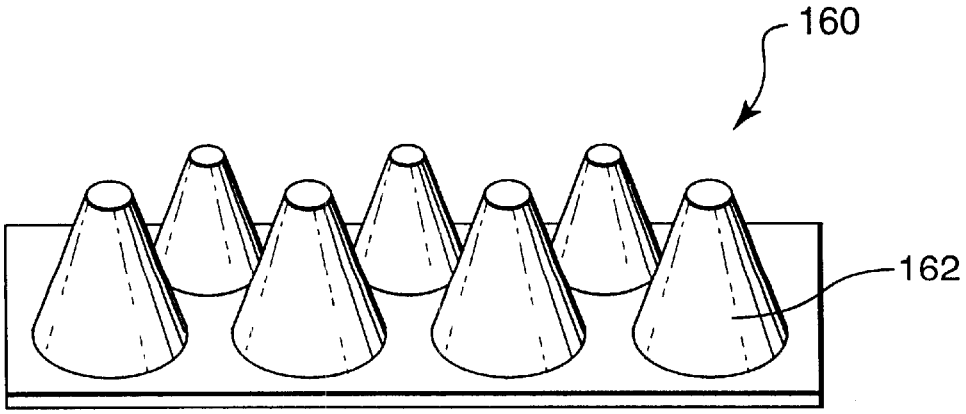
FIG. 8 is a perspective view of a eighth embodiment of an article for polishing a wafer suited for fabrication of semiconductor devices that includes truncated conical structures.
Figure 9:
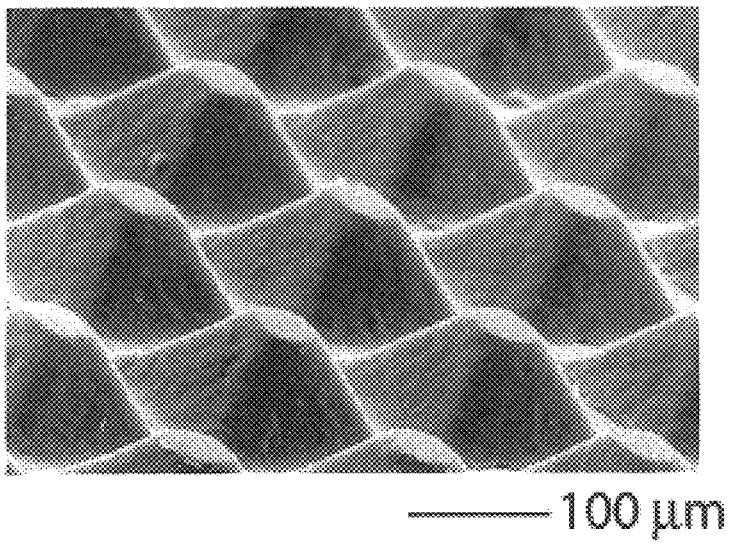
FIG. 9 is an electron micrograph of one embodiment of truncated pyramidal structures.
Figure 10:
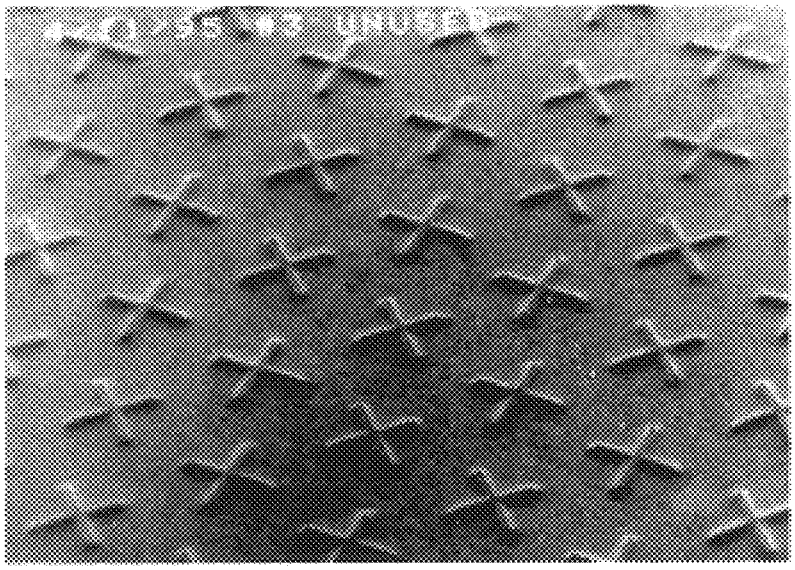
FIG. 10 is an electron micrograph of one embodiment of cross structures.
Figure 11:
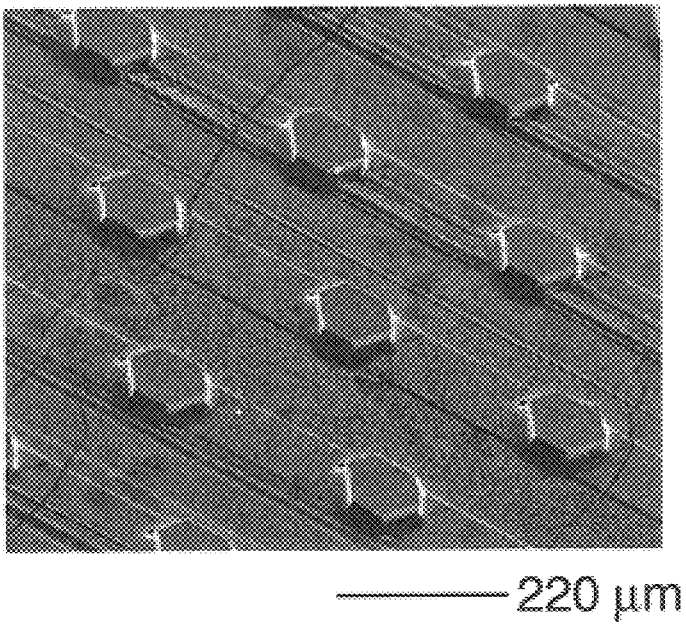
FIG. 11 is an electron micrograph of one embodiment of hexagonal structures.
Figure 12:
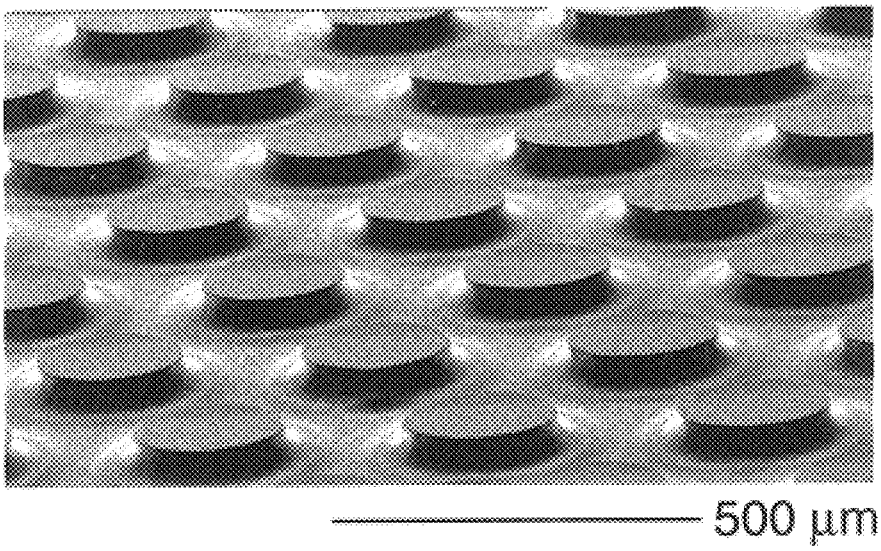
FIG. 12 is an electron micrograph of one embodiment of cylindrical structures

FIG. 8 illustrates an embodiment of the article 160 that includes truncated conical structures 162.

The method of chemically modifying a wafer suited for fabrication of semiconductor devices is preferably conducted in the presence of a liquid polishing composition. The polishing composition is selected based upon the composition of the wafer surface being modified and to provide the desired modification including, e.g., polishing, planarization and combinations thereof, without adversely affecting, e.g., damaging, the wafer.

The polishing composition is further selected to be capable of altering the removal rate of the surface of the wafer being modified. The polishing composition may alter the removal rate by inhibiting or enhancing the removal rate. An example of a polishing composition that inhibits the removal rate is a composition that passivates the surface of the wafer. An example of a polishing composition that enhances the removal rate is an etchant. Other examples of suitable polishing compositions that alter the removal rate of the surface of the wafer include oxidizing agents, reducing agents, passivating agents, complexing agents, buffers, acids, bases and compositions that exhibit a combination of these properties.

The pH of the polishing composition can affect performance and is selected based upon the nature of the wafer surface being modified, including the chemical composition and topography of the wafer surface. In some cases, e.g., where the wafer surface contains metal oxide, e.g., silicon dioxide, the liquid medium may be an aqueous medium having a pH greater than 5, preferably greater than 6, more preferably greater than 10. In some instances, the pH ranges between 10.5 and 14.0, preferably between about 10.5 and 12.5. Examples of suitable polishing compositions include for metal oxide containing wafer surfaces include aqueous solutions containing hydroxide compounds including, e.g., potassium hydroxide, sodium hydroxide, ammonium hydroxide, lithium hydroxide, magnesium hydroxide, calcium hydroxide, barium hydroxide, and basic compounds, e.g., amines. The basic polishing composition may also contain more than one basic material, e.g., a mixture of potassium hydroxide and lithium hydroxide.

In other cases, the pH is no greater than about 6 to about 8, preferably no greater than about 4, most preferably from about 3 to about 3.5. The liquid composition can be distilled or deionized water, which typically has a pH ranging from about 6 to about 8.

The polishing composition may also include a chemical etchant. Examples of chemical etchants include strong acids (e.g., sulfuric acid and hydrofluoric acid), and oxidizing agents, e.g., peroxides.

The polishing composition can also include additives including, e.g., surfactants, wetting agents, buffers, rust inhibitors, lubricants and soaps.

Inorganic particles can also be included in the polishing composition. Examples of inorganic particles include silica, zirconia, calcium carbonate, chromia, ceria, cerium salts (e.g., cerium nitrate), alumina, garnet, silicates and titanium dioxide. The average particle size of the inorganic particle is preferably less than about 1,000 Å, more preferably less than about 500 Å, most preferably less than about 250 Å.

Although the polishing composition can include inorganic particles, the preferred polishing composition is substantially free of inorganic particles. The polishing composition preferably includes less than 1% by weight, more preferably less than 0.1% by weight, most preferably 0% by weight inorganic particles.

The polishing process preferably occurs without audible and visible vibration.

The invention will now be described further by way of the following examples. All parts, ratios, percents and amounts stated in the Examples are by weight unless otherwise specified.

EXAMPLES

Test Procedures

Test procedures used in the examples include the following.

Removal Rate Determination

Removal rate is calculated by determining the change in thickness of the layer being polished from the initial (i.e., before planarizing) thickness and the final (i.e., after planarizing) thickness. For eight inch diameter wafers, thickness measurements are taken with a ResMap 168-4 point probe Rs Mapping Tool (Credence Design Engineering, Inc., Cupertino, Calif.). Eighty point diameter scans are employed.

% Wafer Non-Uniformity Determination

% Wafer non-uniformity is determined by calculating the standard deviation of the change in thickness of the layer being polished at points on the surface of the wafer (as obtained from the Removal Rate Determination), dividing the standard deviation by the average of the changes in thickness of the layer being polished and multiplying the value obtained by 100.

Wafer to Wafer % Non-Uniformity Determination

Wafer to wafer % non-uniformity is calculated by measuring the change in layer thickness (according to the Removal Rate Determination) for a series of wafers that are sequentially polished using a polishing article, calculating the standard deviation of the changes in thickness for the series of wafers, dividing the value obtained by the average of the changes in thickness for the series of wafers and multiplying the value obtained by 100.

Polishing Composition 1

A first polishing composition was prepared by combining 16,990 g distilled water, 200 g iminodiactic acid, 600 g ammonium hydrogen phosphate, 10 g 5-methyl-1H-benzotriazole and 2,200 g of 30% hydrogen peroxide.

Polishing Composition 2

A second polishing composition was prepared by combining 18,195 g distilled water, 400 g iminodiactic acid, 300 g ammonium hydrogen phosphate, 5 g 5-methyl-1H-benzotriazole and 1,100 g of 30% hydrogen peroxide.

Control 1

The polishing pad of Control 1 included a three-dimensional fixed abrasive having cylindrical posts having a height of 38 $\mu$m and a diameter of about 200 $\mu$m.

The fixed abrasive was prepared by combining the following ingredients: 8,268.8 g SR 339 2-phenoxyethyl acrylate (Sartomer, Exton, Pa.), 5,512.5 g SR 9003 propoxylated neopentyl glycol diacrylate (Sartomer), 922.9 g Disperbyk 111 phosphated polyester steric group (BYK Chemie, Wallingford, Conn.), 396.8 g Sipomer β-CEA carboxy ethyl acrylate (Rhodia Inc., Cranbury, N.J.), 147.0 g Irgacure 819 bis(2,4,6-trimethylbenzoyl phenylphosphineoxide (Ciba Specialty Chemicals, Tarrytown, N.Y.), 39,750.0 g Tizox 8109 alumina (Ferro Electronic Materials, Penn Yan, N.Y.) to form an abrasive slurry. The abrasive slurry was then formed into an abrasive article according to General Procedure II for Making the Abrasive Article U.S. Pat. No. 5,958,794 (column 50), which is incorporated herein.

The pad was conditioned using a Mirra 3400 Chemical-Mechanical Polishing System (Applied Materials, Inc., Santa Clara, Calif.) by polishing an 8 inch diameter copper (Cu) disc for 20 minutes at a platen speed of 41 rpm and a carrier speed of 39 rpm. The pressures applied to the carrier inner tube, retaining ring and membrane were 3.0 psi/3.5 psi/3.0 psi, respectively.

Eight inch diameter rate wafers and 8 inch diameter copper dummy discs were then polished, for the periods specified in Table 5, at a platen speed of 41 rpm and a carrier speed of 39 rpm using a Mirra 3400 CMP system. The pressures applied to the carrier inner tube, retaining ring and membrane were 3.0 psi/3.5 psi/3.0 psi, respectively. During polishing, polishing composition 2 was provided to the surface of the discs and wafers at a flow rate of 120 ml/min for the period specified in Table 1.

The total polishing time was 490 minutes.

The apparent bearing area of the polishing pad remained constant at 18%. The apparent area of contact of the post structure(s) of the unit cell was 15,708 $\mu m^2$, the unit cell area was 87,266 $\mu m^2$, the structure volume was 596,904 $\mu m^3$, the unit cell volume was 3,316,108 $\mu m^3$, the unit cell free volume was 2,719,204 $\mu m^3$, the square root of the cell area was 295.4 $\mu m$ and the unit cell parameter was 0.59.

The removal rate and % wafer non-uniformity were calculated. The results are set forth in Table 1.

The average removal rate was 4174 Å/min, the standard deviation was 661.62 Å/min and the wafer to wafer non-uniformity was 15.85%.

TABLE 1

| Sample | Polishing Composition | Time (min) | Cu Removal Rate (Å/min) | % NU |
|---|---|---|---|---|
| 2 Cu discs | 2 | 2/each | NA | NA |
| Wafer | 2 | 2 | 3719 | 12.3 |
| 7 Cu discs | 2 | 2/each | NA | NA |
| Wafer | 2 | 2 | 3679 | 4.3 |
| 7 Cu discs | 2 | 2/each | NA | NA |
| Wafer | 2 | 2 | 3635 | 3.1 |
| 7 Cu discs | 2 | 2/each | NA | NA |
| Wafer | 2 | 2 | 3635 | 3.9 |
| 7 Cu discs | 2 | 2/each | NA | NA |
| Wafer | 2 | 2 | 3562 | 4.1 |
| 7 Cu discs | 2 | 2/each | NA | NA |
| Wafer | 2 | 2 | 3666 | 3.6 |
| 7 Cu discs | 2 | 2/each | NA | NA |
| Wafer | 2 | 2 | 3523 | 4.5 |
| 7 Cu discs | 2 | 2/each | NA | NA |
| Wafer | 2 | 2 | 3632 | 4.4 |
| 7 Cu discs | 2 | 2/each | NA | NA |
| Wafer | 2 | 2 | 3640 | 4.2 |
| 14 Cu discs | 2 | 2/each | NA | NA |
| Wafer | 2 | 2 | 3715 | 4.5 |
| 14 Cu discs | 2 | 2/each | NA | NA |
| Wafer | 2 | 2 | 3923 | 5.3 |
| 14 Cu discs | 2 | 2/each | NA | NA |
| Wafer | 2 | 2 | 4087 | 4.0 |
| 14 Cu discs | 2 | 2/each | NA | NA |
| Wafer | 2 | 2 | 4180 | 3.7 |
| l4 Cu discs | 2 | 2/each | NA | NA |
| Wafer | 2 | 2 | 4281 | 4.4 |

TABLE 1-continued

| Sample | Polishing Composition | Time (min) | Cu Removal Rate (Å/min) | % NU |
|---|---|---|---|---|
| 14 Cu discs | 2 | 2/each | NA | NA |
| Wafer | 2 | 2 | 4688 | 3.1 |
| 14 Cu discs | 2 | 2/each | NA | NA |
| Wafer | 2 | 2 | 4435 | 3.9 |
| 14 Cu discs | 2 | 2/each | NA | NA |
| Wafer | 2 | 2 | 4484 | 4.3 |
| 14 Cu discs | 2 | 2/each | NA | NA |
| Wafer | 2 | 2 | 4885 | 3.4 |
| 14 Cu discs | 2 | 2/each | NA | NA |
| Wafer | 2 | 2 | 5118 | 5.4 |
| 14 Cu discs | 2 | 2/each | NA | NA |
| Wafer | 2 | 2 | 5539 | 8.2 |
| 14 Cu discs | 2 | 2/each | NA | NA |
| Wafer | 2 | 2 | 5625 | 10.3 |

N/A = not applicable
% NU = % wafer non-uniformity

As the removal rate began to drift above 4,000 (Å/min), mild carrier vibrations were observed. As the rate increased from this point, the vibrations of the carrier increased. Near the end of the experiment, the vibrations became severe.

Example 1

The polishing pad of Example 1 included a three-dimensional fixed abrasive having three-sided pyramids having a height of 63 $\mu m$ and each side, although not being identical, having a length of about 125 $\mu m$, and corner angles of 55.5 degrees, 59 degrees and 55.5 degrees.

The fixed abrasive was prepared by combining the following ingredients: 8268.8 g SR 339 2-phenoxyethyl acrylate (Sartomer), 5512.5 g SR 9003 propoxylated neopentyl glycol diacrylate (Sartomer), 922.9 g Disperbyk 111 phosphated polyester steric group (BYK Chemie), 396.8 g Sipomer β-CEA carboxy ethyl acrylate (Rhodia Inc.), 147.0 g Irgacure 819 bis(2,4,6-trimethylbenzoyl phenylphosphineoxide (Ciba Specialty Chemicals), 39,750.0 g Tizox 8109 alumina (Ferro Electronic Materials) to form an abrasive slurry. The abrasive slurry was then formed into an abrasive article according to General Procedure II for Making the Abrasive Article U.S. Pat. No. 5,958,794 (column 50), which is incorporated herein.

The pad was conditioned by polishing an 8 inch copper disc for two minutes at a platen speed of 41 rpm and a carrier speed of 39 rpm using a Mirra 3400 CMP System. The pressure applied to the carrier inner tube, retaining ring and membrane was 3.0 psi/3.5 psi/3.0 psi, respectively.

Eight inch diameter rate wafers and 8 inch diameter copper dummy discs were polished using the Mirra 3400 CMP system as follows: the pressure applied to the carrier inner tube, retaining ring and membrane was 2.0 psi/2.5 psi/2.0 psi, respectively. The platen speed was 41 rpm, and the carrier speed was 39 rpm. During polishing, polishing composition 2 was provided to the surface of the wafer or disc at a flow rate of 180 ml/min for the period specified in Table 2.

The total polishing time was 548 minutes.

The apparent bearing area of the polishing pad increased over time from essentially 0% (i.e., a point) to a final apparent bearing area of 6.5%. At 6.5% apparent bearing area, the apparent area of contact of the pyramid structure(s) of the unit cell was 439.78 $\mu m^2$, the unit cell area was 6,765.82 $\mu m^2$, the structure height was 54.20 $\mu m$, the structure volume was 118,349.59 $\mu m^3$, the unit cell volume was 366,720.82 $\mu m^3$, the unit cell free volume was 248,371.24 $\mu m^3$, the square root of the cell area was 82.25 $\mu m$ and the unit cell parameter was 6.87.

The removal rate and % wafer non-uniformity were calculated and the amount of vibration was observed. The results are set forth in Table 2. The average removal rate was 4011 Å/min, the standard deviation was 93.01 Å/min and the wafer to wafer non-uniformity was 2.32%

The surfaces of the polished wafers were observed to have few to no scratches.

During polishing, no vibration of the carrier was observed.

TABLE 2

| Sample | Polishing Composition | Time (min) | Cu Removal Rate (Å/min) | % NU |
|---|---|---|---|---|
| Cu Disc | Pre-conditioning | 2 | N/A | N/A |
| 2 Cu Discs | 2 | 2.0/each | N/A | N/A |
| Wafer 35 | 2 | 1.5 | 3,889 | 8.6 |
| 8 Cu Discs | 2 | 2.0/each | N/A | N/A |
| Wafer 36 | 2 | 1.5 | 3,993 | 9.6 |
| 8 Cu Discs | 2 | 2.0/each | N/A | N/A |
| Wafer 37 | 2 | 1.5 | 3,916 | 18.7 |
| 8 Cu Discs | 2 | 2.0/each | N/A | N/A |
| Wafer 38 | 2 | 1.5 | 3,991 | 7.2 |
| 8 Cu Discs | 2 | 2.0/each | N/A | N/A |
| Wafer 39 | 2 | 1.5 | 3,911 | 8.6 |
| 8 Cu Discs | 2 | 2.0/each | N/A | N/A |
| Wafer 40 | 2 | 1.5 | 4,040 | 7.6 |
| 8 Cu Discs | 2 | 2.0/each | N/A | N/A |
| Wafer 41 | 2 | 1.5 | 4,025 | 7.2 |
| 8 Cu Discs | 2 | 2.0/each | N/A | N/A |
| Wafer 42 | 2 | 1.5 | 4,132 | 6.0 |
| 8 Cu Discs | 2 | 2.0/each | N/A | N/A |
| Wafer 43 | 2 | 1.5 | 4,041 | 7.5 |
| 8 Cu Discs | 2 | 2.0/each | N/A | N/A |
| Wafer 44 | 2 | 1.5 | 4,069 | 7.6 |
| 8 Cu Discs | 2 | 2.0/each | N/A | N/A |
| Wafer 45 | 2 | 1.5 | 4,158 | 5.4 |
| 8 Cu Discs | 2 | 2.0/each | N/A | N/A |
| Wafer 46 | 2 | 1.5 | 4,058 | 6.6 |
| 8 Cu Discs | 2 | 2.0/each | N/A | N/A |
| Wafer 47 | 2 | 1.5 | 4,011 | 5.3 |
| 8 Cu Discs | 2 | 2.0/each | N/A | N/A |
| Wafer 48 | 2 | 1.5 | 4,054 | 5.8 |
| 8 Cu Discs | 2 | 2.0/each | N/A | N/A |
| Wafer 49 | 2 | 1.5 | 4,187 | 6.5 |
| 8 Cu Discs | 2 | 2.0/each | N/A | N/A |
| Wafer 50 | 2 | 1.5 | 3,980 | 5.2 |
| 8 Cu Discs | 2 | 2.0/each | N/A | N/A |
| Wafer 51 | 2 | 1.5 | 3,994 | 6.9 |
| 8 Cu Discs | 2 | 2.0/each | N/A | N/A |
| Wafer 52 | 2 | 1.5 | 3,933 | 6.8 |
| 8 Cu Discs | 2 | 2.0/each | N/A | N/A |
| Wafer 53 | 2 | 1.5 | 4,189 | 5.0 |
| 8 Cu Discs | 2 | 2.0/each | N/A | N/A |
| Wafer 54 | 2 | 1.5 | 4,093 | 8.1 |
| 8 Cu Discs | 2 | 2.0/each | N/A | N/A |
| Wafer 55 | 2 | 1.5 | 4,049 | 7.4 |
| 8 Cu Discs | 2 | 2.0/each | N/A | N/A |
| Wafer 56 | 2 | 1.5 | 4,111 | 5.7 |
| 8 Cu Discs | 2 | 2.0/each | N/A | N/A |
| Wafer 57 | 2 | 1.5 | 3,878 | 6.4 |
| 8 Cu Discs | 2 | 2.0/each | N/A | N/A |
| Wafer 58 | 2 | 1.5 | 3,897 | 8.3 |
| 8 Cu Discs | 2 | 2.0/each | N/A | N/A |
| Wafer 59 | 2 | 1.5 | 3,991 | 5.3 |
| 8 Cu Discs | 2 | 2.0/each | N/A | N/A |
| Wafer 60 | 2 | 1.5 | 3,903 | 5.7 |
| 8 Cu Discs | 2 | 2.0/each | N/A | N/A |
| Wafer 61 | 2 | 1.5 | 4,030 | 4.8 |
| 8 Cu Discs | 2 | 2.0/each | N/A | N/A |
| Wafer 62 | 2 | 1.5 | 3,837 | 6.6 |

TABLE 2-continued

| Sample | Polishing Composition | Time (min) | Cu Removal Rate (Å/min) | % NU |
|---|---|---|---|---|
| 8 Cu Discs | 2 | 2.0/each | N/A | N/A |
| Wafer 63 | 2 | 1.5 | 4,013 | 7.3 |
| 8 Cu Discs | 2 | 2.0/each | N/A | N/A |
| Wafer 64 | 2 | 1.5 | 3,897 | 5.3 |
| 8 Cu Discs | 2 | 2.0/each | N/A | N/A |
| Wafer 65 | 2 | 1.5 | 4,080 | 5.7 |

N/A = not applicable
% NU = % wafer non-uniformity

Example 2

The polishing pad of Example 2 was prepared according to the method set forth above in Example 1 and included a three-dimensional abrasive composite sheet having three-sided pyramids having a height of 63 $\mu m$ and each side, although not being identical, having a width of about 125 $\mu m$, and corner angles of 55.5 degrees, 59 degrees and 55.5 degrees.

The pad was conditioned using the Mirra 3400 CMP system by polishing for two minutes using an eight inch diameter copper disc at a platen speed of 41 rpm and a carrier speed of 39 rpm. The pressures applied to the carrier inner tube, retaining ring and membrane were 3.0 psi/3.5 psi/3.0 psi, respectively.

Eight inch rate wafers and 8 inch copper discs were polished using the Mirra 3400 CMP system. The pressures applied to the carrier inner tube, retaining ring and membrane were 2.0 psi/2.5 psi/2.0 psi, respectively, the platen speed was 41 rpm and the carrier speed was 39 rpm. During polishing, polishing composition 1 was provided to the surface of the wafer or disc at a flow rate of 180 ml/min for the period specified in Table 3.

The apparent bearing area of the polishing pad increased over time from essentially 0% (i.e., a point) to a final apparent bearing area of 3.1%. At 3.1% apparent bearing area, the apparent area of contact of the pyramid structure(s) of the unit cell was 209.74 $\mu m^2$, the unit cell area was 6,765.82 $\mu m^2$, the structure height was 58.2 $\mu m$, the structure volume was 134,289.87 $\mu m^3$, the unit cell volume was 393,876.35 $\mu m^3$, the free volume of the unit cell was 259,586.48 $\mu m^3$, the square root of the unit cell area was 82.25 $\mu m$ and the unit cell parameter was 15.05.

The removal rate and % wafer non-uniformity were calculated and the amount of vibration was observed. The results are set forth in Table 3.

The average removal rate was 1887 Å/min, the standard deviation was 67.70 Å/min and the wafer to wafer non-uniformity was 3.59%.

The surfaces of the polished wafers were observed to have few to no scratches.

During polishing, no vibration of the carrier was observed.

TABLE 3

| Sample | Polishing Composition | Time (min) | Cu Removal Rate (Å/min) | % NU |
|---|---|---|---|---|
| Cu Disc | Preconditioning | 2 | N/A | N/A |
| 2 Cu discs | 1 | 2.0/each | N/A | N/A |
| Wafer 66 | 1 | 1.5 | 1,909 | 6.9 |
| 12 Cu discs | 1 | 2.0/each | N/A | N/A |
| Wafer 67 | 1 | 1.5 | 1,789 | 2.3 |
| 12 Cu discs | 1 | 2.0/each | N/A | N/A |
| Wafer 68 | 1 | 1.5 | 1,905 | 4.1 |
| 12 Cu discs | 1 | 2.0/each | N/A | N/A |
| Wafer 69 | 1 | 1.5 | 1,791 | 3.1 |
| 25 Cu discs | 1 | 2.0/each | N/A | N/A |
| Wafer 70 | 1 | 1.5 | 1,765 | 7.4 |
| 25 Cu discs | 1 | 2.0/each | N/A | N/A |
| Wafer 71 | 1 | 1.5 | 1,815 | 3.3 |
| 25 Cu discs | 1 | 2.0/each | N/A | N/A |
| Wafer 72 | 1 | 1.5 | 1,873 | 3.5 |
| 25 Cu discs | 1 | 2.0/each | N/A | N/A |
| Wafer 73 | 1 | 1.5 | 1,917 | 3.4 |
| 25 Cu discs | 1 | 2.0/each | N/A | N/A |
| Wafer 74 | 1 | 1.5 | 1,945 | 3.6 |
| 25 Cu discs | 1 | 2.0/each | N/A | N/A |
| Wafer 75 | 1 | 1.5 | 1,909 | 4.1 |
| 25 Cu discs | 1 | 2.0/each | N/A | N/A |
| Wafer 76 | 1 | 1.5 | 1,891 | 3.3 |
| 25 Cu discs | 1 | 2.0/each | N/A | N/A |
| Wafer 77 | 1 | 1.5 | 1,942 | 4.1 |
| 25 Cu discs | 1 | 2.0/each | N/A | N/A |
| Wafer 78 | 1 | 1.5 | 1,865 | 2.8 |
| 25 Cu discs | 1 | 2.0/each | N/A | N/A |
| Wafer 79 | 1 | 1.5 | 1,963 | 6.1 |
| 25 Cu discs | 1 | 2.0/each | N/A | N/A |
| Wafer 80 | 1 | 1.5 | 1,970 | 3.5 |
| 25 Cu discs | 1 | 2.0/each | N/A | N/A |
| Wafer 81 | 1 | 1.5 | 2,007 | 3.6 |

N/A = not applicable
% NU = % wafer non-uniformity

Example 3

The 20 inch diameter polishing pad of Example 3 included a sheet of VIKUTI™ Brightness Enhancement Film II (Minnesota Mining and Manufacturing Company, St. Paul, Minn.) having approximately 200 elongated prismatic structures per centimeter. The sheet was adhered to a foam subpad. The polishing pad was conditioned on a Mirra 3400 CMP system by polishing with a copper disc for 1 to 2 minutes using polishing composition 2 at a rate of 180 ml/min. The pressures applied to the carrier inner tube, retaining ring and membrane were 3.0 psi/3.5 psi/3.0 psi, respectively.

Five copper electroplated 8 inch rate wafers were then polished on the Mirra 3400 CMP system using polishing composition 2 at a rate of 180 ml/min for two minutes each. The pressures applied to the carrier inner tube, retaining ring and membrane were 2.0 psi/2.5 psi/2.0 psi, respectively. The platen speed was 41 rpm and the carrier speed was 39 rpm.

The apparent bearing area of the polishing pad increased over time from essentially 0% (i.e., a line contact) to a final apparent bearing area of 4%. At 4% apparent bearing area, the apparent area of contact of the prismatic structure of the unit cell was 50.00 $\mu m^2$, the unit cell area was 2500.00 $\mu m^2$, the structure height was 36.00 $\mu m$, the structure volume was 45,000.00 $\mu m^3$, the unit cell volume was 90,000.00 $\mu m^3$, the free volume was 45,000.00 $\mu m^3$, the square root of the unit cell area was 50.00 $\mu m$ and the unit cell parameter was 18.00.

The removal rate and % wafer non-uniformity were calculated and the results are set forth in Table 4. The temperature was monitored during the polishing process and remained between 78–83° F. No vibration was detected.

The average removal rate was 3161 Å/min, the standard deviation was 58.43 Å/min and the wafer to wafer non-uniformity was 1.85%.

TABLE 4

| Wafer | Polishing Composition | Time (min) | Cu Removal Rate (Å/min) | % NU |
|---|---|---|---|---|
| Wafer 82 | 2 | 2 | 3069 | 5.76 |
| Wafer 83 | 2 | 2 | 3217 | 4.41 |
| Wafer 84 | 2 | 2 | 3150 | 4.49 |
| Wafer 85 | 2 | 2 | 3162 | 4.11 |
| Wafer 86 | 2 | 2 | 3205 | 4.49 |

% NU = % wafer non-uniformity

Other embodiments are within the claims. For example, in another embodiment of the article for modifying the surface of a wafer suited for fabrication of semiconductor devices, the three-dimensional structures are essentially free of abrasive particles and the unit cell parameter $[[V_1-Vs]/Aas]/\sqrt{Auc}$ is greater than 1.

In other embodiments, the polishing article includes regions having a plurality of unit cells and regions that are free of unit cells.

What is claimed is:

1. An article suitable for use in chemical mechanical planarization processes, said article comprising:

a) a first element comprising a plurality of unit cells repeating across a surface of said article, the individual unit cells each comprising at least a portion of a three-dimensional structure, said three-dimensional structure being essentially free of inorganic abrasive particles, said unit cell being characterized by a unit cell parameter as follows:

$$[[V_1-Vs]/Aas]/\sqrt{Auc}>1$$

where $V_1$ is the volume defined by the area of said unit veil and the height of said structure of said unit cell, Vs is the volume of said structure of said unit cell, Aas is an apparent contact area of said structure, and Auc is the area of said unit cell;

b) a relatively resilient element; and c) a relatively rigid element disposed between said relatively resilient element and said first element.

2. The article of claim 1, wherein said three-dimensional structure is capable of contributing to the chemical modification of the surface of a wafer suited for fabrication of semiconductor devices.

3. A web comprising the article of claim 1.

4. A circular polishing pad comprising the article of claim 1.

5. An article suitable for use in chemical mechanical planarization processes, said article comprising an element comprising a plurality of unit cells repeating across a surface of said article, the individual unit cells each comprising at least a portion of a three-dimensional structure, said three-dimensional structure being essentially free of inorganic abrasive particles and being capable of contributing to the chemical modification of a surface of a wafer suited for fabrication of semiconductor devices, said unit cell being characterized by a unit cell parameter as follows:

$$[[V_1-Vs]/Aas]/\sqrt{Auc}>1$$

where $V_1$ is the volume defined by the area of said unit cell and the height of said structure of said unit cell, Vs is the volume of said structure of said unit cell, Aas is an apparent contact area of said structure, and Auc is the area of said unit cell.

6. The article of claim 5, further comprising:

a) a relatively resilient element; and b) a relatively rigid element disposed between said relatively resilient element and said first element.

7. An article suitable for use in chemical mechanical planarization processes, said article comprising:

an element comprising a plurality of unit cells repeating across a surface of said element, the individual unit cells each comprising at least a portion of a three-dimensional structure, said unit cell being characterized by a unit cell parameter as follows:

$$[[V_1-Vs]/Aas]/\sqrt{Auc}>5$$

where $V_1$ is the volume defined by the area of said unit cell and the height of said structure of said unit cell, Vs is the volume of said structure of said unit cell, Aas is an apparent contact area of said structure of said unit cell, and Auc is the area of said unit cell.

8. The article of claim 7 wherein said three-dimensional structures comprise abrasive particles.

9. The article of claim 8, wherein said abrasive particles are capable of contributing to the chemical modification of a surface of a wafer suited for fabrication of semiconductor devices.

10. The article of claim 8, wherein said three-dimensional structures are capable of contributing to the chemical modification of a surface of a wafer suited for fabrication of semiconductor devices.

11. The article of claim 8, further comprising:

a) a relatively resilient element; and b) a relatively rigid element disposed between said relatively resilient element and said first element.

12. The article of claim 8, said article being capable of removing at least about 500 Å/minute from at least on wafer suited for fabrication of semiconductor devices for a period of at least about 200 minutes.

13. The article of claim 8, said article being capable of removing at least about 500 Å/minute from a plurality of wafers suited for fabrication of semiconductor devices and providing wafers having no greater than about 10% wafer non-uniformity.

14. A web comprising the article of claim 8.

15. A circular polishing pad comprising the article of claim 8.

* * * * *

UNITED STATES PATENT AND TRADEMARK OFFICE

CERTIFICATE OF CORRECTION

PATENT NO. : 6,612,916 B2
DATED : September 2, 2003
INVENTOR(S) : Kollodge, Jeffrey S.

It is certified that error appears in the above-identified patent and that said Letters Patent is hereby corrected as shown below:

Column 4,
Line 65, delete “an” preceding “amount”.

Column 5,
Line 3, delete “by products” and insert in place thereof -- byproducts --.

Column 6,
Line 65, delete “by products” and insert in place thereof -- byproducts --.

Column 7,
Line 40, insert -- to -- followng “relative”.

Column 9,
Lines 20 and 21, delete “um” and insert in place thereof -- µm --.

Column 10,
Line 2, delete “homogenously” and insert in place thereof -- homogeneously --.
Lines 48 and 49, delete “um” and insert in place thereof -- µm --.

Column 12,
Line 46, delete “reslient” and insert in place thereof -- resilient --.

Column 13,
Line 7, delete “40” and insert in place thereof -- 140 --.
Line 44, delete “include” folowing “compositions”.

Column 19,
Line 40, delete “VIKUTI ™” and insert in place thereof -- VIKUITI ™ --.

UNITED STATES PATENT AND TRADEMARK OFFICE

CERTIFICATE OF CORRECTION

PATENT NO. : 6,612,916 B2
DATED : September 2, 2003
INVENTOR(S) : Kollodge, Jeffrey S.

It is certified that error appears in the above-identified patent and that said Letters Patent is hereby corrected as shown below:

Column 20,
Line 42, delete “veil” and insert in place thereof -- cell --.

Column 22,
Line 17, delete “on” and insert in place thereof -- one --.

Signed and Sealed this

Third Day of August, 2004

JON W. DUDAS
*Acting Director of the United States Patent and Trademark Office*